United States Patent [19]

Coons

[11] 4,238,074

[45] Dec. 9, 1980

[54] ATTENDANT PROPELLED PORTABLE SPRAYING APPARATUS

[76] Inventor: Scott Coons, 5511 Erlands Pt., Bremerton, Wash. 98310

[21] Appl. No.: 753,737

[22] Filed: Dec. 23, 1976

[51] Int. Cl.[3] ..... B05B 7/30

[52] U.S. Cl. ..... 239/199; 239/310; 137/355.12

[58] Field of Search ..... 239/146, 148, 172, 175, 239/176, 195–199, 310; 137/355.12, 355.27

[56] References Cited

U.S. PATENT DOCUMENTS

| | | | |
|---|---|---|---|
| 1,278,236 | 9/1918 | Sieben | 239/199 |
| 3,202,362 | 8/1965 | Wright | 239/287 |
| 3,913,837 | 10/1975 | Grant | 239/198 |
| 3,940,065 | 2/1976 | Ware et al. | 239/146 |

FOREIGN PATENT DOCUMENTS

| | | | |
|---|---|---|---|
| 617842 | 2/1949 | United Kingdom | 239/199 |

*Primary Examiner*—John J. Love
*Attorney, Agent, or Firm*—Delbert J. Barnard

[57] ABSTRACT

A wheeled cart having an L-shaped frame, carrys a pressurized water operated proportioning apparatus, including an inlet fitting, a check valve, a pressure regulator and a jet pump, connected together in series, and mounted to extend across the cart generally at the juncture of the horizontal and vertical portions of the cart frame. A liquid chemical storage tank is mounted onto the horizontal portion and a hose reel, having a built-in swivel-coupling type inlet for the hose, is journaled for rotation onto the vertical portion. The inlet of the swivel coupling, the storage tank outlet and the jet pump are located on the same side of the cart. A liquid chemical is aspirated from the storage tank through filters and a metering apparatus by the jet pump, is admixed into the pressurized water, and the mixture is pumped into a spray hose that, when not in use, is wound onto the hose reel.

2 Claims, 3 Drawing Figures

ATTENDANT PROPELLED PORTABLE SPRAYING APPARATUS

BACKGROUND OF THE INVENTION

1. Field of the Invention

The present invention relates to spraying apparatus, and more particularly to a wheeled, walking attendant propelled, spraying apparatus including a storage tank for a liquid chemical, a jet pump to mix the chemical with water, and a hose reel having a hose and a sprayer wound on it to spray the resulting admixture.

2. Description of the Prior Art

A wide variety of portable spraying apparatus are well-known. Some involve a large capacity tank in which the chemical to be sprayed, such as insecticide or fertilizer, has been pre-mixed with water. Such an apparatus is inconvenient to use since the weight of the full tank makes it difficult or impossible for the operator to carry. If the tank is mounted on a cart, it may be difficult to propell, and the combined weight of the cart and tank may damage any vegetation over which the cart travels. In addition, some type of pump is usually needed to supply pressure for spraying, which increases the cost and complexity of such an apparatus.

Further, if an incompatible chemical is subsequently used it may be necessary to dispose of or store large volumes of premixed solution left over in the tank, and a large capacity tank is especially difficult to clean and neutralize properly to prevent contamination of the new chemical. Typical of an apparatus using a simple two-wheeled cart and an electric pump is U.S. Pat. No. 3,940,065, granted to Ware et al, Feb. 24, 1976.

Another variety of portable spraying apparatus dilutes a concentrated liquid chemical that is stored in a small tank that is part of the apparatus and sprays the resulting admixture. Such an apparatus is generally adapted to be connected to the end of a garden hose, as in U.S. Pat. No. 1,082,141, granted Dec. 23, 1913 to Sites. It may also include a jet pump to aspirate the chemical from the tank and mix it with the supply of pressurized water. The use of a jet pump to mix a concentrated chemical with water is disclosed by U.S. Pat. No. 2,135,969, granted Nov. 8, 1938 to Donaldson.

Such apparatus generally have a small storage tank for the concentrated chemical because a large storage tank renders the apparatus heavy and awkward to use. However, a small capacity tank must be refilled frequently resulting in the loss of time to the operator, increased danger of spilled chemical, and the chance that the apparatus will be broken during the frequent refilling operation.

Operator fatigue and inconvenience may increase when such an apparatus is used at a distance from the source of water, since the operator may be required to drag along behind him heavy lengths of hose, which may be subject to entanglement and wear from abrasion. Such problems may be eased by using a conventional hose cart having a hose storage reel upon which the hose is wound.

If a high pressure source of water is used with such an apparatus, such as to compensate for the loss of pressure experienced when using long lengths of hose, the apparatus may not function properly when inadvertently connected more directly to the water source, since many jet pumps and spray heads are adapted to function properly only within a limited pressure range. Should the source of water pressure fail, such units are also subject to undesirable back flow which may withdraw chemicals from the apparatus into the water supply system, thereby contaminating it.

SUMMARY OF THE INVENTION

In basic form, the attendant propelled, portable spraying apparatus of the present invention comprises an L-shaped cart having horizontal and vertical cart portions, and a wheel on each side of the cart rotatably mounted onto the cart at or near the intersection of the cart portions. A tank for storing a liquid chemical is attached to the horizontal cart portion, a hose reel with swivel coupling is journaled onto the vertical cart portion, and a water driven jet pump is provided to aspirate the chemical from the tank through a metering device, to mix the chemical with water and to deliver the mixture to the inlet of the swivel coupling.

In a further aspect of the present invention, the pressurized water may be delivered to the pumping fluid inlet of jet pump through an inlet fitting, a vacuum breaker, a check valve and a pressure regulator.

It is an object of the present invention to provide a portable spraying apparatus that can be assembled entirely from conventional components, including a common, two wheeled, garden hose cart upon which the rest of the components are mounted.

Another object of the present invention is to provide a portable spraying apparatus that has great compactness, simplicity and durability as the result of the unique arrangement and location of its various components on the cart.

To this end, the present invention's pressurized water receiving inlet, vacuum breaker, first check valve, pressure regulator and jet pump are all arranged across the cart in a simple series connection. In addition, by locating the jet pump, the inlet for the swivel coupling, and the storage tank outlet on the same side of the cart, the length and complexity of fluid conduits needed to interconnect these components is reduced to a minimum. Finally, the storage tank is secured to the horizontal cart portion below and forwardly of the hose reel, so that the hose reel and storage tank are in a partially overlapped relation, resulting in a desirable compactness for the present invention.

A further object of the present invention is to provide a portable spraying apparatus with a maximum of spray quality, operator convenience and safety.

To insure high spray quality, the pressure regulator maintains the water pressure at a pre-determined, desired level to insure proper jet pump and spray head operation. In addition, the precision metering means used allows precise control of mix ratios of the chemical to water over a wide range of values, and is protected by filters according to another aspect of the present invention.

Operator convenience is insured by a further aspect of the present invention in which there is a friction fit between the cap and the storage tank outlet, and in which the cap carries the metering device, the filters and the inlet tube. Thus, the operator may, with one motion, easily remove or replace the cap along with its associated metering device, filters and inlet tube to fill the tank, to service the metering device, or to clean the filters. Further, since the cap is not screwed on, there is no chance of twisting or kinking the fluid conduit between the cap and the jet pump. Operator convenience is further insured by another aspect of the present invention that includes having the inlet that receives water from the pressurized water source directed rearwardly with respect to the cart, so that the water supply hose may be easily secured to it.

Safety is enhanced by another aspect of the present invention that includes check valves and a vacuum breaker which prevent any possibility of back flow of the chemical into the water supply, which might otherwise contaminate it.

Further objects of the present invention are to provide a portable spraying apparatus that may be easily wheeled by the operator to the location where needed, that is light weight so as to minimize any damage to the vegetation over which it travels, and which is adapted to be used with a commercial spray truck as a water source. Because it is self-contained, except for a water supply, the present invention needs no assembly, and is ready to use at a moment's notice.

These and further objects, features, advantages and characteristics of the portable spraying apparatus of the present invention will be apparent from the following more detailed description of the preferred embodiment.

DESCRIPTION OF THE PREFERRED EMBODIMENTS

Figure 2:
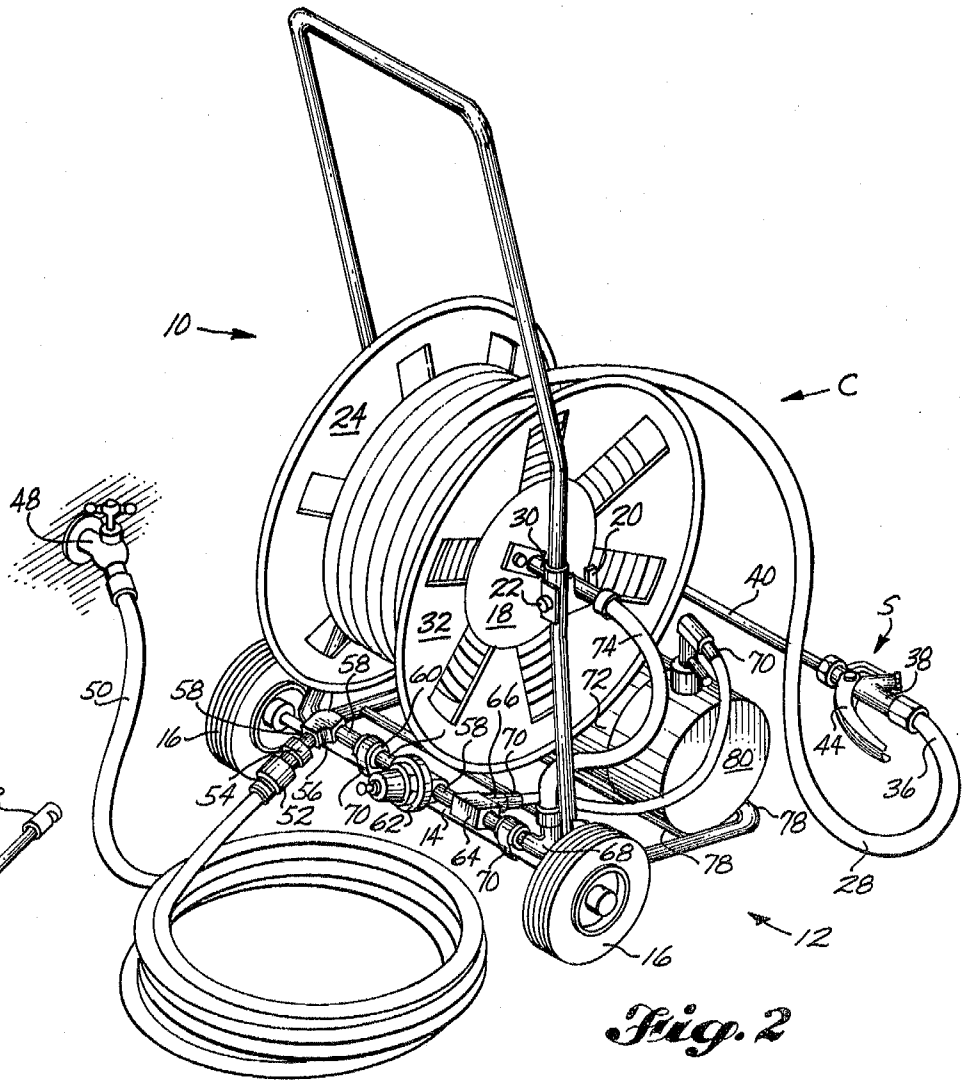
FIG. 2 is a rear perspective view from an upper aspect of the portable spraying apparatus of the present invention.
Figure 1:
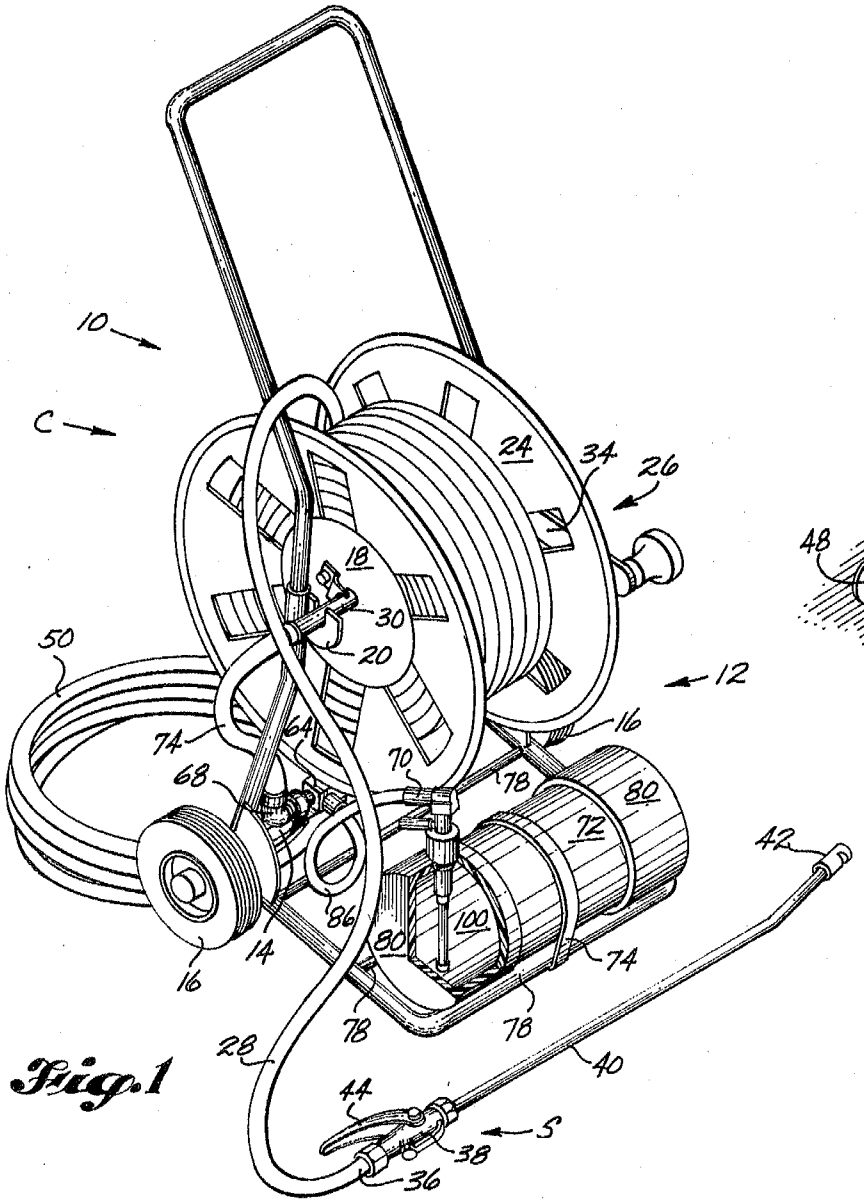
FIG. 1 is a front perspective view from an upper aspect of the portable spraying apparatus of the present invention, with the inlet portion of the tank shown cut away.

Referring to FIGS. 1 and 2, the portable spraying apparatus of the present invention is shown using a cart, generally designated at C, upon which the rest of the apparatus is mounted. Cart C is of conventional construction, has a metal, tubular frame and comprises a vertical cart portion, generally designated at 10, and a horizontal, lower cart portion, generally designated at 12. A support shaft 14 is rigidly affixed to the frame, as by welding, at the juncture of the horizontal and vertical cart portions and serves to both reinforce the frame and to act as an axle having a wheel 16 rotatably mounted to each end.

When the cart is at rest, the weight of the hose reel and storage tank cause the cart to tip forward until the front of the horizontal cart portion contacts the earth, resulting in a stable rest posture wherein the cart is supported by both the wheels and the front of the horizontal cart portion. When it is desired to move the cart, the operator tips the cart backward until the horizontal cart portion no longer contacts the ground and then wheels the cart to wherever needed.

A cylindrical hose reel 18 is journaled to the vertical cart portion and is supported by reel brackets 20 which are secured to the vertical cart portion by fasteners 22. The first side 24 of the hose reel 18 is carried by a crank 26 having a support portion, not shown, which rides on a support bracket and whose end is fixedly attached, as by welding, to the first side 24 of the hose reel near the hose reel axis.

Within the hose reel 18 is a swivel coupling of conventional construction, not shown, having an outlet that rotates with the hose reel 18 and is adapted to be connected to one end of the spray hose 28 that is wound on the hose reel 18. The non-rotating inlet tube 30 for the swivel coupling passes through an aperature on the second side 32 of the hose reel, near the hose reel's axis, and rests on a support bracket 20, thereby supporting the second side 32 of the hose reel. The hose reel 18 can then be rotated, both clockwise and counterclockwise, by exerting an appropriate force on the handle portion 34 of the crank 26. The hose cart C, complete with hose reel 18 and swivel coupling is available commercially as a unit, such as the True Temper Deluxe Hose Reel and Utility Cart, Model HR-45, made by True Temper of Ashtabular, Ohio. Of course, there are many different kinds of such units that are available from a variety of sources, so it is understood that the present invention contemplates the use of any of them, even though their details of construction may vary.

Figure 3:
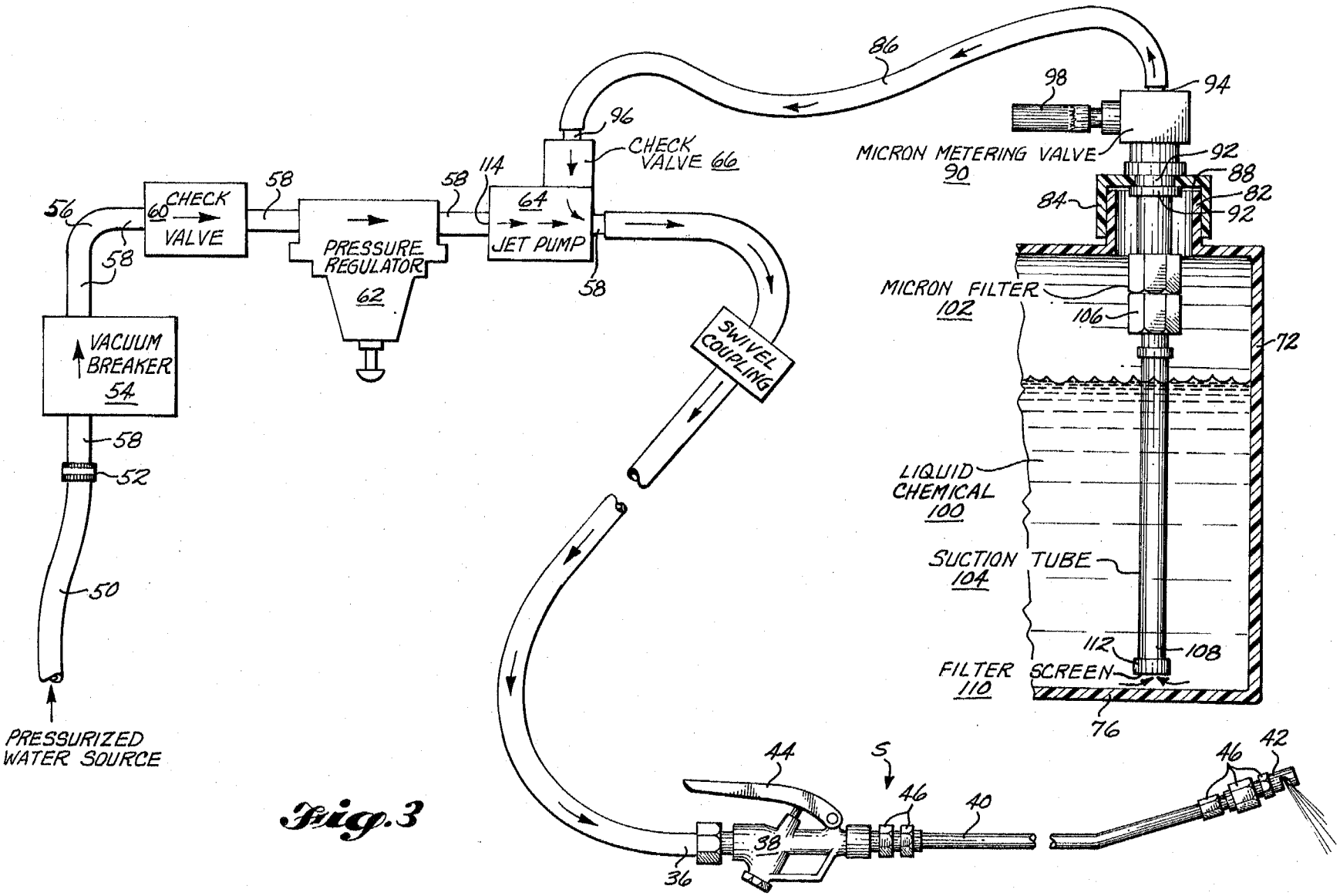
FIG. 3 is a schematic, pictorial representation thereof.

As best shown in FIG. 3, a spray means, generally designated at S, is connected to the free end 36 of the spray hose. The spray means S comprises a handle 38, an extension tube 40, and a spray head 42. The handle includes a spring loaded valve, of conventional construction, not shown, that is normally closed. The valve is opened by squeezing the actuating lever 44, thereby permitting fluid to flow to the spray head 42 through the extension tube 40. The valve closes automatically when the actuating lever 44 is released.

The extension tube 40 and the spray head 42 are threadedly connected to the handle and to the extension tube, respectively, by any suitable means, such as connectors 46. This construction permits the interchangeable use of a variety of forms of extension tubes 40 and spray heads 42 as the situation encountered by the operator demands.

Although one particular form of spray means S is illustrated, it is to be understood that any form of spray means S that can be adapted for connection to the free end 36 of the spray hose is suitable for use in the present invention.

Typical components, suitable for use with the present invention are a spray handle Model 6590 made by Spraying Systems of Wheaton, Illinois; an extension tube No. 27165-7, made by Delavan Manufacturing, of West Des Moines, Iowa; and a spray head Model F-15, made by Delavan Manufacturing of West Des Moines, Iowa.

As best seen in FIG. 2, pressurized water is supplied from a faucet 48 which taps any suitable source, such as a fixed plumbing system or a portable source of pressurized water, such as a tank truck. The water supply hose 50 has one end connected to the faucet 48 and the other end connected to the inlet 52 of the portable spraying apparatus of the present invention. The inlet 52 is threadedly connected to a vacuum breaker 54 which is, in turn, connected to one end of the first right angle elbow 56 by short lengths of connection pipe 58. The first elbow 56 directs the inlet 52 to extend rearwardly with respect to the cart C so that the operator may more conveniently attach the supply hose 50 thereto. The vacuum breaker 54, of conventional construction, is designed to relieve any vacuum that might develop in the water supply hose 50, to thereby prevent any back flow of chemical 100 which might otherwise contaminate the supply hose 50 or source of pressurized water. Vacuum breaker 54 includes internally a check valve, not shown, which also serves to prevent any back flow of chemical 100.

The other end of the first elbow 56, the first check valve 60, the pressure regulator 62, the jet pump 64 and the second right angle elbow 68 are all connected in a series connection extending across the support shaft 14 by short lengths of connection pipe 58 and are all secured to the support shaft by any suitable means, such as band clamps 70. These components are all threadedly interconnected to allow easy replacement for repair of the individual components.

The first check valve 60 serves like the vacuum breaker 54, to insure that no backflow of chemical 100 into the supply hose 50 or source of pressurized water occurs. In addition, check valve 60 includes an internal filter screen, not shown, to prevent clogging of all downstream components. The pressure regulator 62 maintains the water pressure into the jet pump 64 at a predetermined level to insure proper jet pump 64 and spray head 42 operation. The volume of flow of fluid through the spraying apparatus may be varied according to operator demands by varying the pressure setting of the pressure regulator 62 or by replacing the pressure regulator 62 with a regulator of larger or smaller capacity. The jet pump 64, powered by pressurized water, aspirates the chemical 100 from the tank 72, mixes it with water and delivers the admixture to the inlet 30 of the swivel coupling through a hose 74 connecting the outlet of the second elbow and the inlet 30 of the swivel coupling. Jet pump 64 includes a check valve 66 to prevent any backflow of fluid from the jet pump 64 into hose 86. The volume of flow through the jet pump 64 may be varied, according to the operator's requirements by changing the size of a nozzle, not shown, located within the jet pump 64 or by replacing jet 64 with a pump of larger or smaller capacity.

Typical components, suitable for use with the present invention, are a vacuum breaker Model HVB-8A, made by Watts Regulator Company of Laurence, Mass.; a check valve and strainer with brass housing Model No. 4193A, made by Spraying Systems of Wheaton, Illinois; a pressure regulator, Model A31, made by A. W. Cash Valve Manufacturing Corporation of Decatur, Illinois, which operates to reduce the supply pressure to 60 psi; and a jet pump Model No. 202, made by Dema Engineering Company of St. Louis, Missouri.

Referring now to FIGS. 1 and 3, a storage tank 72 for the liquid chemical 100, such as insecticide or fertilizer, is fastened to the front end of the horizontal cart portion 12 by any suitable means, as by a strap 74. The strap 74 may be constructed so that the tank 72 is detachably mounted to the horizontal cart portion 12 thereby permitting the tank to be removed for easy cleaning or enabling one tank 72, that is filled with one type of chemical 100, to be easily replaced with another tank 72 for another type of chemical 100. The tank 72 may be of any size so long as it does not interfere with the free rotation of the hose reel 18. The base 76 of the tank 72 is sized to be supported by the cross pieces 78, or the spacing between the cross pieces 78 is sized to support the base 76 of the tank 72 selected. The tank 72 may be of any conventional construction, or it may be constructed, as shown in FIG. 1, from a 13½ inch length of a 6 inch plastic pipe which has a end cap 80 glued to each end in a fashion well known to those skilled in the art. Preferably, a relatively inert plastic is selected, such as PVC, to prevent any reaction between the tank 72 and the chemical 100 which is stored.

Referring to FIG. 3, the tank 72 has an outlet 82, located on its top surface near one end, that extends upwardly therefrom for a short distance. Covering and surrounding a substantial portion of this outlet is an aperatured cap 84 which preferably has a friction fit with the outlet 82. A threaded connection therebetween is possible but not desirable because of the increased tendency of such a connection to twist or kink the hose 86 connecting the tank 72 and the jet pump 64 when the connection is screwed or unscrewed. An aperatured gasket 88 is fastened to the top surface of the interior of the cap 84 by any suitable means, such as glueing, prevents leakage of the chemical 100 stored in the tank 72.

A micron metering valve 90 extends above the cap 84 and has a base 92 which extends through and snugly fits the aperatures in the cap 84 and gasket 88 in a sealing relation to prevent leakage of chemical 100 from the tank 72. The cap 84 and metering valve 90 are held in a tightly assembled relation, as by an O-ring 92. The outlet 94 of the metering valve and the pumped fluid inlet 96 of the jet pump 64 are connected by a collapse resistant hose 86 which is secured at each end by any suitable means, as by band clamps 70. The metering valve 90 regulates the rate of withdrawal of the liquid chemical 100 from the tank 72, and is adjustable by turning the adjusting stem 98. Because of its precision construction, a wide range of accurate ratios of liquid chemical to water are obtainable.

A micron filter 102, threadedly connected to the base 92 of the micron meter, removes particles of contamination from the liquid chemical 100 that are greater in size than 50–125 microns. This prevents clogging of the micron meter 90.

A plastic or metal suction tube 104, threadedly connected to the micron filter 102, as by a nut 106, extends into the tank 72 and has an inlet 108 adjacent to the base 76 of the tank 72. A filter screen 110 is secured over the inlet 108 of the suction tube, as by a clamp 112, and filters out coarse particles from the liquid chemical 100.

As is apparent, the connections used to hold the cap 84, metering valve 90, micron filter 102 and suction tube 104 in assembled relation permit the easy disassembly of these components for repair, cleaning or replacement.

In order to achieve maximum simplicity and compactness and to reduce the length of the hoses 86, 74 it is preferred that the jet pump 64, the outlet 30 of the swivel coupling and the tank outlet 82 be located on the same side of the cart C.

Typical components suitable for use with the present invention are a micron metering valve such as the Milli Mite forged metering valve, Model 1315M4B and a micron filter Model 631F4B, with bronze element Model No. 80411-1, all made by Hoke, Inc. of Cresskill, N.J.

The portable spraying apparatus of the present invention may be stored at the work site. However, it is light and compact enough to be easily and conveniently transported by a car or truck to a remote work site.

In use, the cap 84, with its associated filters 102, 110, metering valve 90 and suction tube 104 is removed from the tank 72, the tank 72 is cleansed of any noncompatible chemical 100, the desired chemical 100 is added to the tank 72, and the cap 84 is replaced. The operator then selects the mix ratio desired by an appropriate setting of the adjusting stem 98 on the micron metering valve. One end of the supply hose 50 is then connected to the faucet 48 and its other end is connected to the inlet 52 of the present invention and the faucet 48 is opened.

The cart C is then wheeled to wherever needed, or the operator may carry the spray means S to wherever desired, allowing the spray hose 28 to pay out from the hose reel 18 behind him. The actuating lever 44 is depressed on the spray means S and the admixture is sprayed in the usual fashion.

As best shown in FIGS. 1 and 3, the water flows from the faucet 48 into the pumping fluid inlet 114 of the jet pump 64 through the fluid conduit formed by the supply hose 50, the inlet 52, the vacuum breaker 60, the first elbow 56, the first check valve 60, the pressure regulator 62 and their associated connection pipes 58. The liquid chemical 100 flows from the tank 72 to the pumped fluid inlet 96 of the jet pump through the fluid conduit formed by the suction tube 104, the micron filter 102, the metering valve 90, the hose 86 and check valve 66. The jet pump 64 dilutes the chemical 100 with water and delivers the admixture to the spray head 42 for spraying through the fluid conduit formed by the second elbow 68, the hose 74, the swivel coupling, the spray hose 28, the handle 38, the extension tube 40 and their associated connection pipes 58.

From the foregoing, various further applications, modifications and adaptations of the apparatus disclosed by the foregoing preferred embodiments of the present invention will be apparent to those skilled in the art to which the present invention is addressed, within the scope of the following claims.

What is claimed is:

1. A wheeled, walking attendant propelled spraying apparatus, comprising:

a cart comprising a frame and wheels connected to a lower portion of the frame, a spray hose storage reel adapted to receive a length of hose thereon, means journaling said reel onto said frame for rotation during wrapping and unwrapping of the spray hose, a swivel coupling including an outlet rotatable with the spray hose storage reel which is connectible to the spray hose and a non-rotating inlet located at one end of said spray hose storage reel, said frame including a forward projecting shelf generally below the reel, and a handle above the spray hose storage reel;

a storage tank for a liquid to be sprayed, mounted onto said shelf generally below the hose storage reel;

apparatus for removing a liquid from said tank and delivering it in diluted form into the inlet of said swivel coupling, comprising an inlet fitting connectible to a water hose and a jet pump connected in series and mounted onto said cart frame, said jet pump having a pumping fluid passageway in water receiving communication with said inlet fitting, a pumped fluid inlet and a combined fluid outlet, a first conduit interconnected between the combined fluid outlet of said jet pump and the inlet of said swivel coupling, and a second conduit interconnected between the storage tank and the pumped fluid inlet of said jet pump, said second conduit including flexible hose means and adjustable metering means to regulate the rate of removal of liquid from the storage tank; and wherein a first check valve is provided in series with and between the inlet fitting and the jet pump, for preventing back flow through the jet pump into the water supply, and wherein a second check valve is provided in the second conduit, to prevent back flow from the jet pump into the second conduit;

whereby the cart can be wheeled into a yard, a hose can be connected between a water faucet and the inlet fitting, and the spray hose can be unwrapped from the reel and used by an operator to spray a water diluted liquid without the encumbrance of a mixing apparatus at the outlet end of the spray hose.

2. Apparatus according to claim 1, comprising conduit means interconnected between the inlet fitting and the pumping fluid inlet of the jet pump, wherein said inlet fitting, said conduit means and said jet pump extend along a lower rear frame portion of the cart, wherein the jet pump is positioned on the cart generally vertically below the inlet of the swivel coupling and said inlet fitting is located generally below the opposite end of the spray hose storage reel, and is generally rearwardly directed.

* * * * *